US005590441A

United States Patent [19]

Spencer

[11] Patent Number: 5,590,441

[45] Date of Patent: Jan. 7, 1997

[54] LIFT-OFF DOOR HINGE

[75] Inventor: Jeffrey C. Spencer, Macomb Township, Mich.

[73] Assignee: General Motors Corporation, Detroit, Mich.

[21] Appl. No.: 395,134

[22] Filed: Feb. 27, 1995

[51] Int. Cl.[6] ..... E05D 7/10

[52] U.S. Cl. ..... 16/264; 16/261; 16/265

[58] Field of Search ..... 16/260, 265, 261, 16/264, 270

[56] References Cited

U.S. PATENT DOCUMENTS

| | | | |
|---|---|---|---|
| 598,215 | 2/1898 | Corscaden | 16/260 |
| 1,091,690 | 3/1914 | Welch | 16/265 |
| 3,205,007 | 9/1965 | Sommer | 297/429 |
| 4,446,596 | 5/1984 | Arlauskas | 16/333 |
| 4,532,675 | 8/1985 | Salazar | 16/335 |
| 4,720,895 | 1/1988 | Peebles | 16/264 |
| 4,748,718 | 6/1988 | Harrison | 16/254 |
| 4,765,025 | 8/1988 | Salazar | 16/261 |
| 4,766,643 | 8/1988 | Salazar | 16/222 |
| 4,800,624 | 1/1989 | Whitefoot et al. | 16/332 |
| 4,854,009 | 8/1989 | Brockhaus | 16/264 |
| 4,858,274 | 8/1989 | Harrison et al. | 16/265 |
| 4,864,687 | 9/1989 | Calcaterra et al. | 16/237 |
| 4,881,298 | 11/1989 | Turnbull | 16/266 |
| 5,008,975 | 4/1991 | Wang et al. | 16/260 |
| 5,018,243 | 5/1991 | Anspaugh et al. | 16/335 |
| 5,054,165 | 10/1991 | Marchione | 16/270 |
| 5,067,201 | 11/1991 | Marchione | 16/270 |
| 5,218,738 | 6/1993 | Krajenke | 16/334 |
| 5,297,314 | 3/1994 | Bender et al. | 16/270 |
| 5,404,618 | 4/1995 | Heiler et al. | 16/261 |

FOREIGN PATENT DOCUMENTS

| | | | |
|---|---|---|---|
| 2502676 | 10/1982 | France | 16/260 |
| 2657112 | 7/1991 | France | 16/265 |
| 5-239971 | 9/1993 | Japan | 16/260 |

OTHER PUBLICATIONS

WO 91/10032; Pub. Date: 11 Jul. 1991; Inventor: Svensson.

*Primary Examiner*—M. Rachuba
*Assistant Examiner*—Donald M. Gurley
*Attorney, Agent, or Firm*—Ernest E. Helms

[57] ABSTRACT

An automotive lift-off type door hinge is provided which includes a body side hinge having a vertical leg for attachment with a body opening frame, the body side hinge having joined to the vertical leg a horizontal leg which has a stop pin aperture and spaced therefrom a pivot pin aperture; an upper door side hinge having a vertical leg extending upwardly for attachment to a door, the upper door side hinge having joined to the vertical leg a horizontal leg having a pivot pin aperture; a lower door side hinge having a downwardly extending vertical leg connected to the door by a removable fastener, the lower door hinge having joined to the vertical leg a horizontal leg sandwiching the horizontal leg of the body hinge between the horizontal legs of the upper and lower door side hinges, and the horizontal leg of the lower door side hinge having a pivot pin aperture; a pivot pin providing a thrust bearing for the upper door side hinge loosely fitted in the upper door side hinge pivot aperture to allow upward door removal, and the pivot pin permanently affixing the lower door side hinge horizontal leg to the body side hinge horizontal leg when the door is lifted up to be removed; and a stop pin positioned in the stop pin aperture to limit opening of the door by contact on at least one of the upper or lower door side hinges horizontal leg.

5 Claims, 4 Drawing Sheets

LIFT-OFF DOOR HINGE

FIELD OF THE INVENTION

The field of the present invention is that of door hinges for automotive-type vehicles. More particularly, the field of the present invention is that of door hinges for automotive-type vehicles wherein the door may be readily removed during the assembly process.

BACKGROUND OF THE INVENTION

In most automotive assembly plants, a vehicle body is fabricated and the doors are attached. The automotive vehicle goes through the painting process with the doors attached to ensure proper color matching between the paint on the doors and the remainder of the automotive body. As the automotive vehicle proceeds along the assembly process, the doors are left open as the assemblers install the instrument panel, the seating and other interior components. To increase the quality of installation and to address other ergonomic issues, there is a growing tendency to remove the vehicle doors from the automotive body after the painting process to allow greater ease of access to the interior of the vehicle and then reattach the doors to the vehicle further down the assembly process. This technique of automotive assembly is called "doors off" installation. To accomplish this, various removable type door hinges have previously been brought forth.

SUMMARY OF THE INVENTION

The present invention provides a removable door hinge which is an alternative to that previously available which is extremely low in cost, has its main components fabricated from low cost steel stampings, and can be packaged in an extremely small area.

DESCRIPTION OF THE PREFERRED EMBODIMENTS

Figure 1:
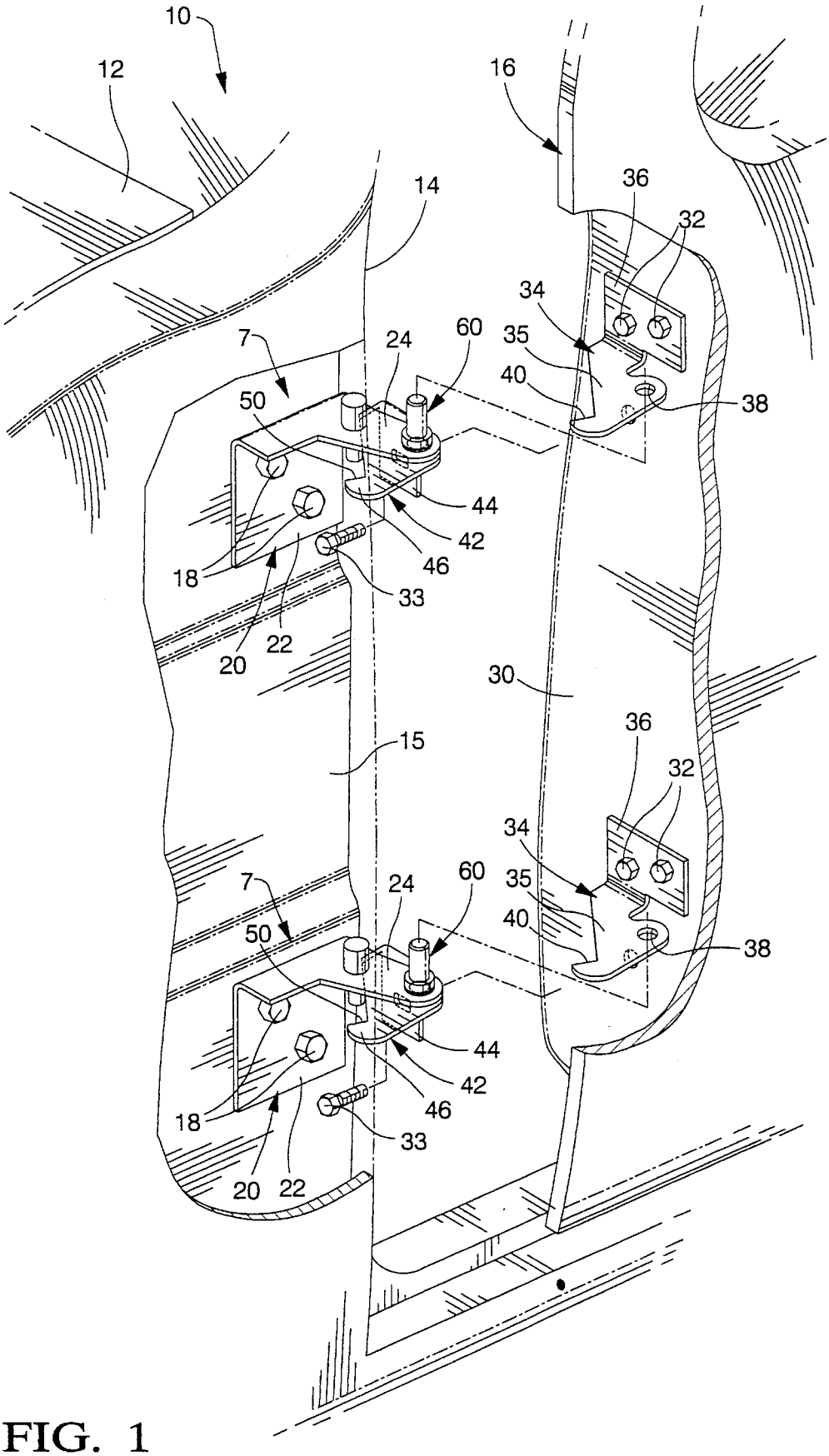
FIG. 1 is a perspective view illustrating a door after removal from an automotive vehicle body showing the environment of the present inventive automotive door hinge utilized in the upper and lower hinge assemblies.

Referring to FIGS. 1 through 5, an automotive vehicle 10 has a car body 12 with a door opening 14. To cover the door opening 14 there is provided a vehicle door 16. Pivotally connecting the door 16 to the vehicle body 12 are top and bottom removable hinge assemblies 7. The vehicle body has a frame member or portion 15 formed of sheet metal which is generally parallel to the orientation of the door opening 14. Joined to the body side sheet metal 15 by two bolts 18 is a body side hinge 20. The body side hinge 20 has a generally vertical descending leg 22. Joined to the vertical leg 22 and extending therefrom in a generally horizontal fashion is a horizontal leg 24. The horizontal leg 24 has a stop pin aperture 26 and a pivot pin aperture 28. The body side hinge 20 is typically made from a steel stamping.

The door 16 has a side wall 30. Joined to the side wall 30 by bolts 32 is an upper door side hinge 34. Upper door side hinge 34 has a generally upwardly vertically extending leg 36 which generally has an orientation perpendicular to the door opening 14 and perpendicular to the lower extending leg 22 of the body side hinge (when the door 16 is closed). The upper door hinge 34 also has a horizontal leg 35 with a pivot pin aperture 38 generally aligned with the pivot pin aperture 28 of the body side hinge. The upper door hinge 34 is also provided with a stop contact surface 40.

Figure 3:
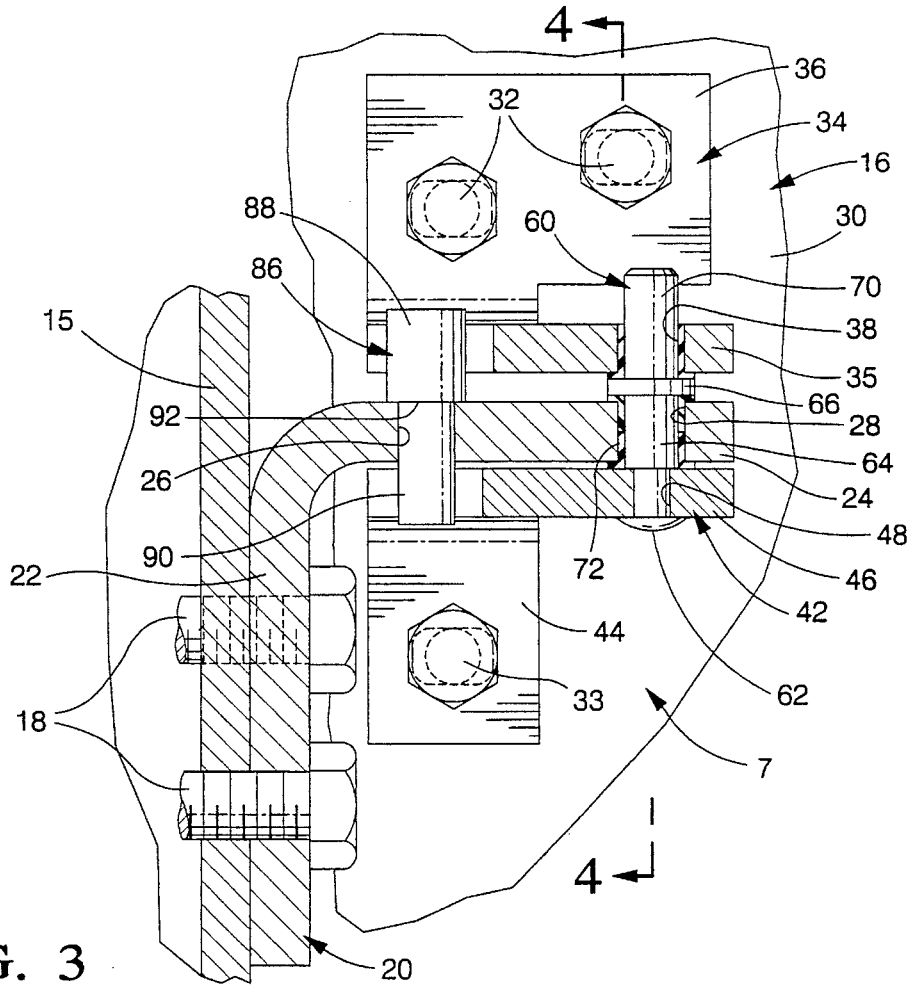
FIG. 3 is a view taken along line 3—3 of FIG. 2.
Figure 4:
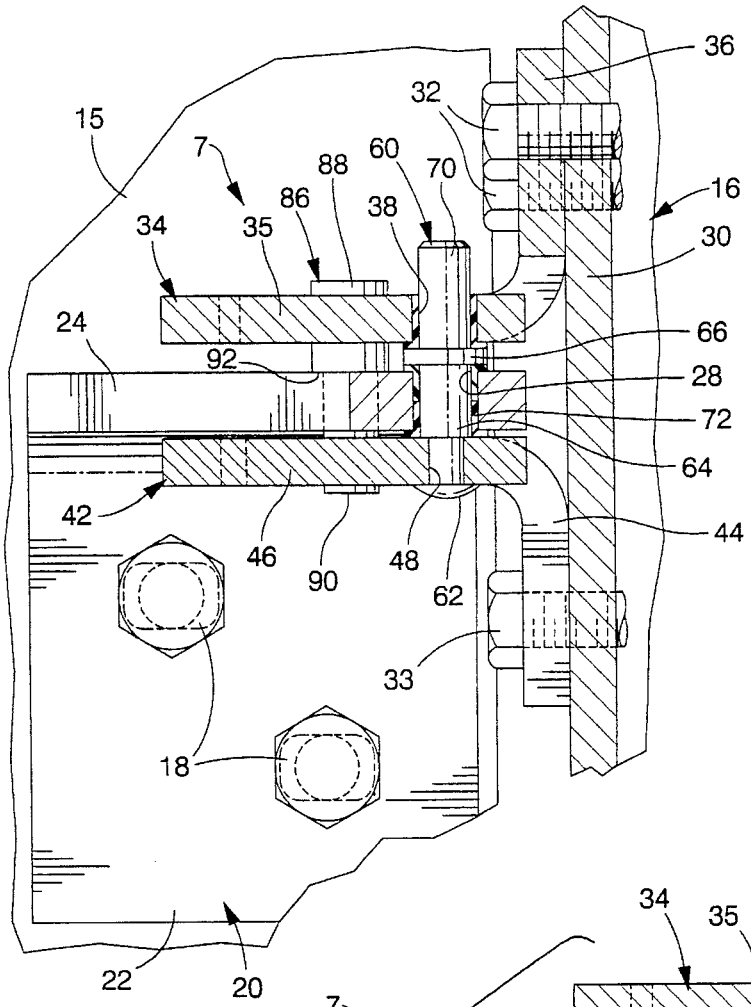
FIG. 4 is a view taken along line 4—4 of FIG. 3.
Figure 5:
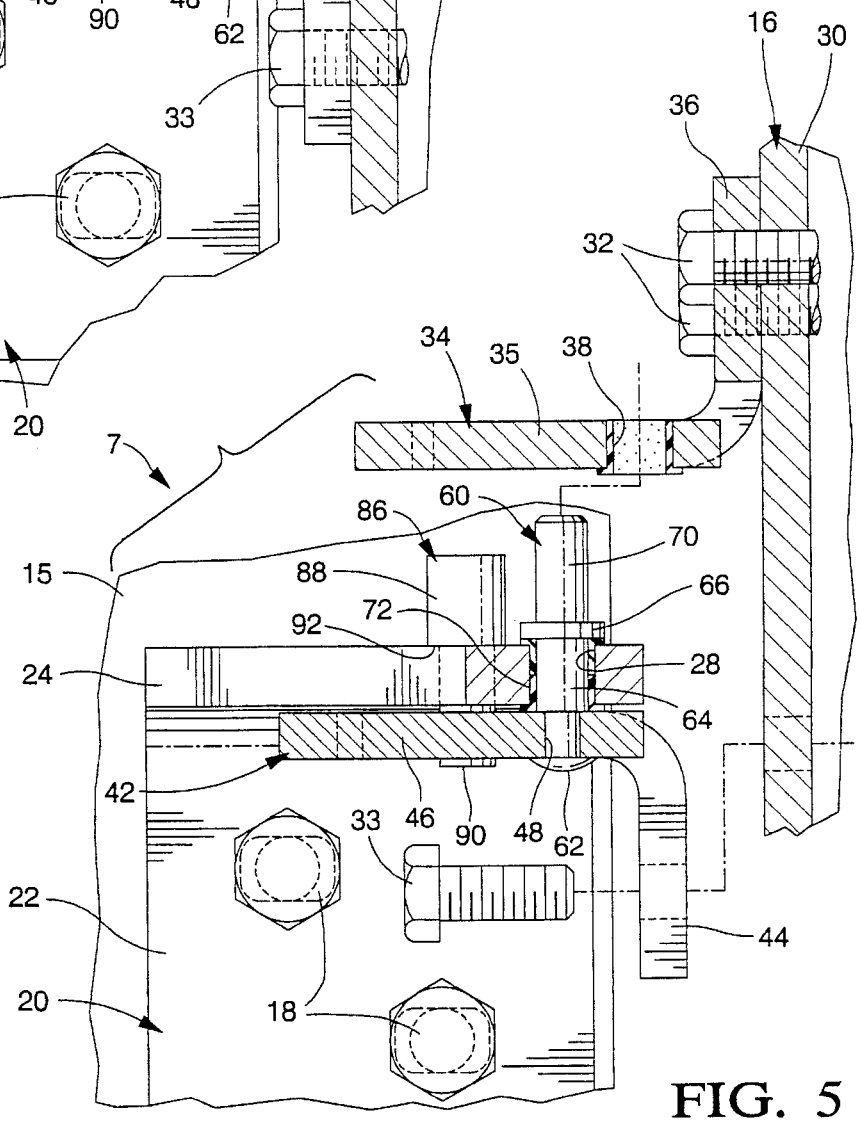
FIG. 5 is a view similar to that of FIG. 4 showing removal of the door.

Joined to the door side wall 30 by a removable bolt 33 is a lower door side hinge 42 (FIGS. 3, 4 and 5). The lower door side hinge 42 has a generally vertically descending leg 44 which is also generally perpendicular to the vertical leg 22 of the body side hinge (when the door 16 is closed). Joined to the vertically descending 44 is a generally horizontal leg 46 which extends outwardly to juxtapose the horizontal leg 24 of the body side hinge between the lower door side hinge and the upper door side hinge horizontal legs 35, 46 (shown best in FIGS. 3, 4 and 5). The horizontal leg 46 has an aperture 48 generally aligned with the aforementioned apertures 28 and 38. Additionally, the lower door side hinge 42 has a contact surface 50 along the horizontal leg 46.

A pivot pin 60 is also provided having a head 62, a small diameter portion which can be press fitted within the aperture 48, and a mid diameter portion 64 along with a thrust-bearing portion 66 and head 70. The pin 60 is loosely fitted within the body side hinge horizontal leg 24 having a side bearing 72 lubricated by the appropriate type grease or other lubricant. The pin 60 is also very loosely fitted upon the horizontal leg 35 of the upper door side hinge so that it may be lifted upward as desired, as best shown in FIG. 5. The enlarged section 66 provides a thrust bearing to support the weight provided by the door 16.

Figure 6:
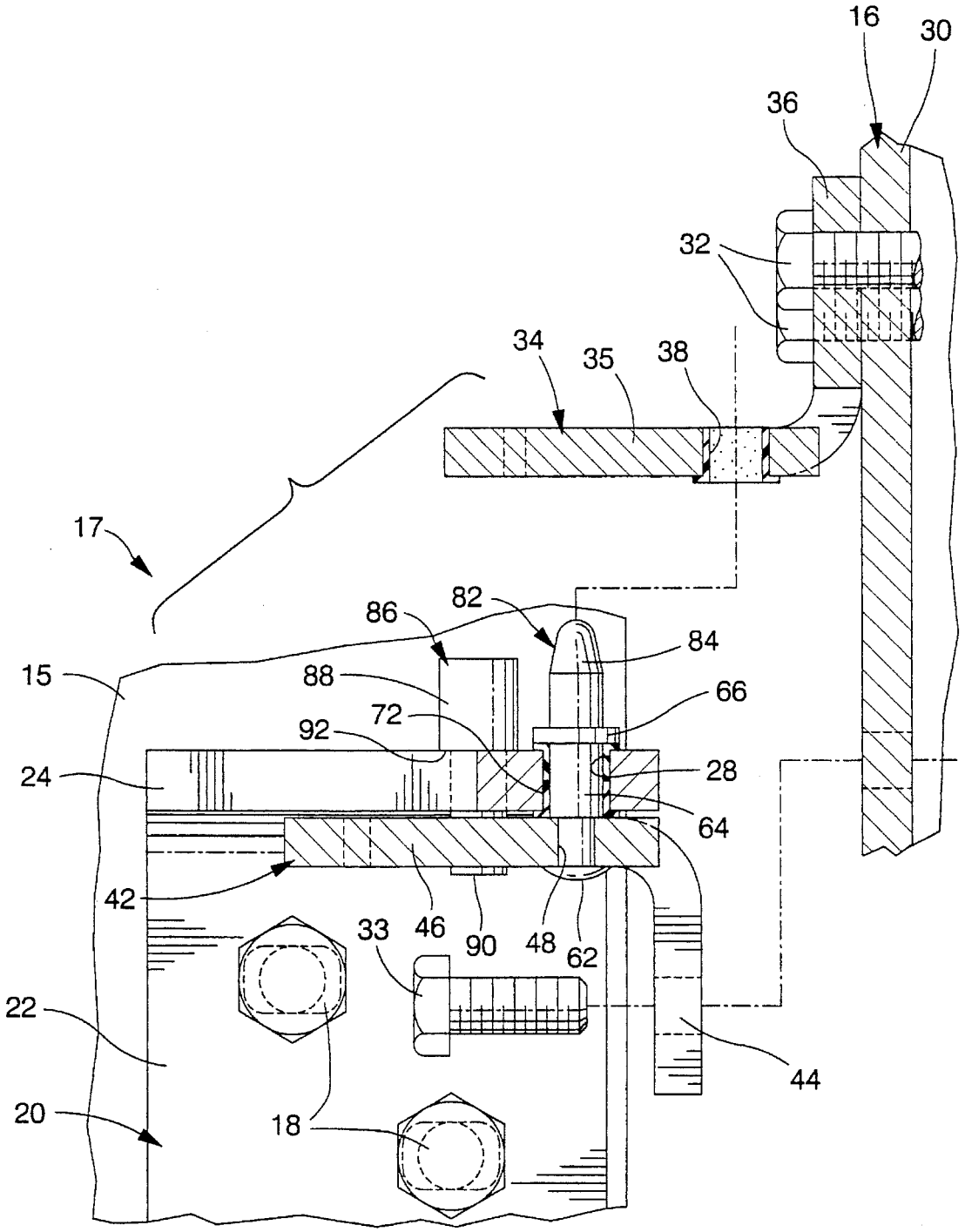
FIG. 6 is a view similar to that of FIG. 5 showing an alternative preferred embodiment of the present invention.

As best shown in FIG. 5, to remove the door 16 from the vehicle, (after the body painting process to allow greater ease of access to the interior of the vehicle to further assembly), the fastener 33 is removed (from the vertically descending legs 44 of both the top and bottom hinge assemblies), and the door 16 can then be lifted off of the pivot pins 60. Both lower door hinges 42 remains attached to the body side hinge 20 by virtue of the heads 62 of the respective pivot pins 60. In an embodiment of the present invention shown in FIG. 6, the pivot pin 82 is provided with all other components being generally identical wherein the pivot pin 82 has a conical head 84 to provide locational guidance when attempting to reattach the door to the car body via the hinge assembly 17.

Figure 2:
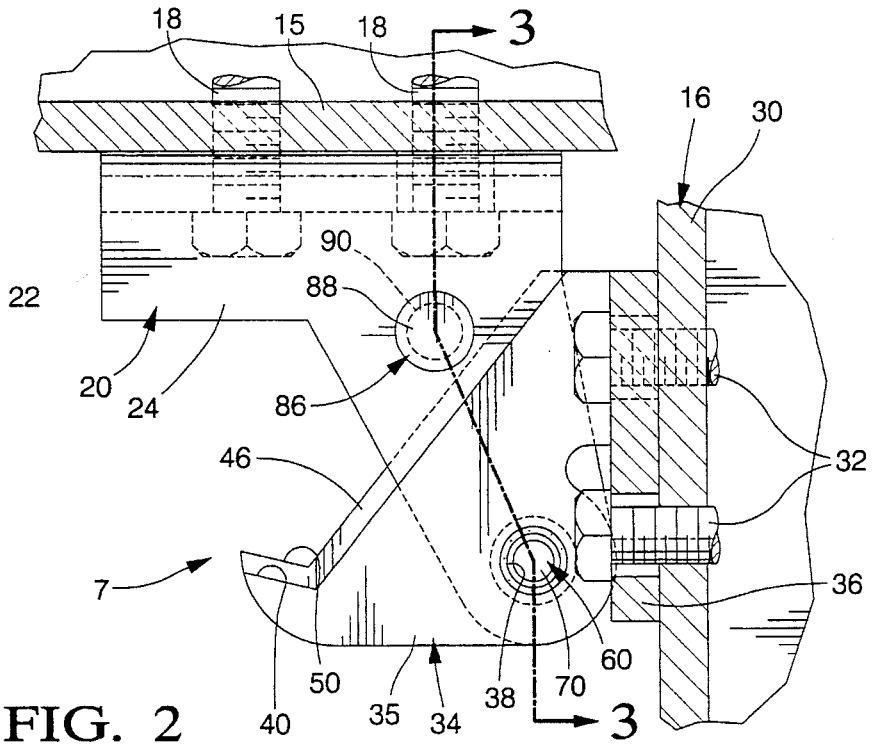
FIG. 2 is an enlarged plane elevational view with some portions sectioned of a door hinge illustrated in FIG. 1.

A stop pin 86 is provided having a head 88 and a lower body 90 with a shoulder 92 which separates the head from the lower body. The pin 86 is press fit into the stop aperture 26 and bottoms out upon the shoulder 92. The stop surfaces 50 and 40, respectively, are configured to hit at the same time so that shock loading associated with opening of the vehicle door is generally equally distributed into the upper and lower door hinges 34 and 42. Referring to FIGS. 1 and 2, the hinge 7 assemblies are attached to the door 16, typically at the front end of the door, and an opening motion of the door causes the door side hinges 34 and 42 to move in a clockwise manner as best shown in FIG. 2 until such time as contact with stop surfaces 50 and 40 is made with the pin 86.

While this invention has been described in terms of a preferred embodiment thereof, it will be appreciated that other forms could readily be adapted by one skilled in the art. Accordingly, the scope of this invention is to be considered limited only by the following claims.

What is claimed is:

1. A lift-off type door hinge assembly for a door of an automotive vehicle which has a body with an opening frame, the hinge assembly comprising:

a body side hinge having a generally vertical leg for attachment with the opening frame, the body side hinge having joined to the vertical leg a horizontal leg extending outwardly, the horizontal leg having a stop pin aperture and spaced therefrom a pivot pin aperture;

an upper door side hinge having a generally vertical leg extending upwardly for attachment to the vehicle door, the upper door side hinge having joined to the vertical leg a horizontal leg extending therefrom, the horizontal leg having an aperture generally aligned with the pivot pin aperture in the generally horizontal leg of the body side hinge;

a lower door side hinge having a vertical leg generally downwardly extending, the vertical leg being connected to the door by a removable fastener, the lower door side hinge having joined to the vertical leg a horizontal leg extending therefrom sandwiching the horizontal leg of the body hinge between the horizontal legs of the upper and lower door side hinges, and the horizontal leg of the lower door side hinge having an aperture generally aligned with the pivot pin aperture in the generally horizontal leg of the body side hinge;

a pivot pin providing a thrust bearing for the upper door side hinge loosely fitted in the upper door side hinge pivot aperture to allow upward door removal, and the pivot pin permanently affixing the lower door side hinge horizontal leg to the body side hinge horizontal leg when the door is lifted up to be removed; and a stop pin positioned in the stop pin aperture to limit opening of the door by contact on at least one of the upper or lower door side hinges horizontal leg.

2. A removable door hinge as described in claim 1 wherein both of the horizontal legs of the door side hinges make contact with the stop pin.

3. An automotive door hinge as described in claim 1 wherein the generally vertical legs of the door hinges and the opening frame hinges are oriented generally perpendicular to each other when the door is in a generally closed position.

4. An automotive door hinge as described in claim 1 wherein a top edge of the pivot pin has a cam surface for locating the upper door side hinge.

5. A lift-off type door hinge for a door of an automotive vehicle, the automotive vehicle having a body with an opening frame, the hinge comprising:

a body side hinge having a generally vertical leg for attachment with the opening frame, the vertical leg being generally parallel to the opening and the vertical leg having joined thereto a generally horizontal leg extending outwardly, the horizontal leg having a stop pin aperture and spaced therefrom a pivot pin aperture;

an upper door side hinge having a generally vertical leg oriented generally perpendicular to the body side vertical leg, the upper door side hinge vertical leg extending upwardly for attachment to the vehicle door, the upper door side hinge having joined to the upwardly extending vertical leg a generally horizontal leg extending therefrom with an aperture generally aligned with the pivot pin aperture in the generally horizontal leg of the body side hinge, the upper door side hinge horizontal leg having a stop surface;

a lower door side hinge with a vertical leg oriented generally perpendicular to the vertical leg of the door side hinge and the lower door side hinge vertical leg being connected to the door by a removable fastener, the lower door side hinge having joined to the vertical leg a horizontal leg extending therefrom with an aperture generally aligned with the pivot pin aperture in the generally horizontal leg of the body side hinge, the lower door side hinge horizontal leg having a stop surface, and the lower body side hinge horizontal leg juxtaposes the horizontal leg of the body side hinge between itself and the horizontal leg of the upper door side hinge;

a pivot pin providing a thrust bearing for the upper door side hinge being loosely fitted upon the upper door side hinge to allow upward door removal and the pivot pin permanently pivotally affixing the lower door hinge horizontal leg to the body side hinge; and a stop pin positioned in the stop pin aperture to make contact with the stop surfaces of the vertical legs of the upper and lower door side hinges by contact therewith to limit the opening of the door with respect to the vehicle door opening.

* * * * *